US008931928B2

(12) United States Patent
Heintz

(10) Patent No.: US 8,931,928 B2
(45) Date of Patent: Jan. 13, 2015

(54) REMOVABLE WINDOW FRAME FOR LIGHTING MODULE

(75) Inventor: Brian G. Heintz, Portland, OR (US)

(73) Assignee: Phoseon Technology, Inc., Hillsboro, OR (US)

( * ) Notice: Subject to any disclaimer, the term of this patent is extended or adjusted under 35 U.S.C. 154(b) by 228 days.

(21) Appl. No.: 13/286,711

(22) Filed: Nov. 1, 2011

(65) Prior Publication Data

US 2013/0107532 A1 May 2, 2013

(51) Int. Cl.

| | |
|---|---|
| ***F21V 3/00*** | (2006.01) |
| ***F21V 5/00*** | (2006.01) |
| ***F21V 31/00*** | (2006.01) |
| ***F21V 17/12*** | (2006.01) |

(52) U.S. Cl.

CPC ..... *F21V 31/005* (2013.01); *F21V 17/12* (2013.01)

USPC ..... 362/311.01; 362/249.02; 362/125; 362/249.01; 362/362; 362/374

(58) Field of Classification Search

USPC ..... 362/125, 227, 240, 249.01–249.02, 362/255, 311.01, 311.02, 311.14, 362, 367, 362/368, 374–375

See application file for complete search history.

(56) References Cited

U.S. PATENT DOCUMENTS

| | | | | |
|---|---|---|---|---|
| 2,791,681 | A * | 5/1957 | Evans et al. | 362/374 |
| 3,644,729 | A * | 2/1972 | McFarlin | 362/375 |
| 5,154,507 | A | 10/1992 | Collins | |
| 5,857,767 | A | 1/1999 | Hochstein | |
| 5,936,353 | A | 8/1999 | Triner et al. | |
| 6,200,134 | B1 | 3/2001 | Kovac et al. | |
| 6,457,823 | B1 | 10/2002 | Cleary et al. | |
| 6,501,084 | B1 | 12/2002 | Sakai et al. | |
| 6,683,421 | B1 | 1/2004 | Kennedy et al. | |
| 6,692,250 | B1 | 2/2004 | Decaudin et al. | |
| 6,902,303 | B2 * | 6/2005 | Lee | 362/362 |
| 8,021,024 | B2 | 9/2011 | Huang | |
| 8,438,721 | B1 * | 5/2013 | Sill | 29/603.03 |
| 2001/0046652 | A1 | 11/2001 | Ostler et al. | |

(Continued)

FOREIGN PATENT DOCUMENTS

| | | | |
|---|---|---|---|
| DE | 19619154 | A1 | 6/1997 |
| DE | 10127171 | A1 | 12/2001 |

(Continued)

OTHER PUBLICATIONS

ISA Korea, International Search Report and Written Opinion of PCT/US2012/062857, Mar. 15, 2013, WIPO, 10 pages.

(Continued)

*Primary Examiner* — Nimeshkumar Patel
*Assistant Examiner* — Jose M Diaz
(74) *Attorney, Agent, or Firm* — Alleman Hall McCoy Russell & Tuttle LLP

(57) ABSTRACT

A lighting module has an array of light-emitting elements, a housing defining at least one opening, and a window frame that is selectively removable from the opening of the housing. The window frame has a frame and a window that is operably secured to the frame. The array of light-emitting elements is positioned within the housing. The window frame is replaceable or selectively removable from the housing of the lighting module. The window frame may include a gasket that is positioned between the frame and a portion of the window that is operably secured to the frame. In some examples, the gasket is a die-cut expanded PTFE gasket.

20 Claims, 4 Drawing Sheets

(56) References Cited

U.S. PATENT DOCUMENTS

| | | | | |
|---|---|---|---|---|
| 2002/0187454 | A1 | 12/2002 | Melikechi et al. | |
| 2003/0043582 | A1 | 3/2003 | Chan et al. | |
| 2003/0081096 | A1 | 5/2003 | Young | |
| 2004/0032726 | A1* | 2/2004 | Lee | 362/33 |
| 2004/0120155 | A1* | 6/2004 | Suenaga | 362/362 |
| 2009/0180281 | A1* | 7/2009 | Ahland et al. | 362/234 |
| 2010/0085767 | A1* | 4/2010 | Boyer et al. | 362/368 |
| 2010/0296287 | A1* | 11/2010 | Huang | 362/249.02 |
| 2011/0273877 | A1* | 11/2011 | Reed et al. | 362/235 |

FOREIGN PATENT DOCUMENTS

| | | | |
|---|---|---|---|
| EP | 0879582 | A1 | 11/1998 |
| EP | 1158761 | A1 | 11/2001 |
| EP | 1599340 | B1 | 9/2007 |
| JP | H07319402 | A | 12/1995 |
| JP | 2010044872 | A | 2/2010 |
| JP | 2010056045 | A | 3/2010 |
| WO | 9507731 | A1 | 3/1995 |
| WO | 0059671 | A1 | 10/2000 |
| WO | 0067048 | A2 | 11/2000 |
| WO | 0211640 | A2 | 2/2002 |
| WO | 0213231 | A2 | 2/2002 |
| WO | 03023875 | A2 | 3/2003 |

OTHER PUBLICATIONS

Data Sheet for G*SiC Technology Super Blue LEDs No. C430-CB290-E1200, manufactured by Opto Semiconductors, May 1, 1999, 8 pages.

Data Sheet for 5.0 mm Blue Series LEDs No. LNG992CFB, manufactured by the Panasonic Corporation, Mar. 2001, 1 page.

Data Sheet for 3.0 mm Blue Series LEDs No. LNG997CKB, manufactured by the Panasonic Corporation, Mar. 2001, 1 page.

Data Sheet for G*SiC Technology Ultraviolet LEDs No. C395-MB290-E0400, manufactured by Cree, Inc., 2 pages.

* cited by examiner

REMOVABLE WINDOW FRAME FOR LIGHTING MODULE

BACKGROUND & SUMMARY

Solid-state light emitters, such as light emitting diodes (LEDs) and laser diodes, have several advantages over using more traditional arc lamps during curing processes, such as ultraviolet (UV) curing processes. Solid-state light emitters generally use less power, generate less heat, produce a higher quality cure, and have higher reliability than the traditional arc lamps. Some modifications increase the effectiveness and efficiency of the solid-state light emitters even further.

For example, solid-state light emitters emit light from within a housing or enclosure through a window. While solid-state light emitters emit less heat than their arc lamp counterparts, the temperatures emitted from the solid-state light emitters is still very high. These high temperatures cause damage to the components of the solid-state light emitters over time. Sometimes components such as the window through which the light is emitted is broken or shattered due to the effects of the high temperatures or from use or abuse of the device.

In another example, solid-state light emitters emit light from within a housing or enclosure through a window that is secured to some portion of the housing, which is usually done by a strong adhesive, such as a UV cured adhesive. Because of the permanent nature of this UV curing adhesive process, replacing a broken or worn window is difficult and time-consuming. Further, replacing such a window often requires the owner to send the entire system to the manufacturer or other repair location, which results in a significant amount of downtime and increased costs and project delays for the user.

Most current solid-state light emitters do not address the durability of the window or the downtime required to repair or replace windows.

DETAILED DESCRIPTION OF THE EMBODIMENTS

Figures 1, 2:
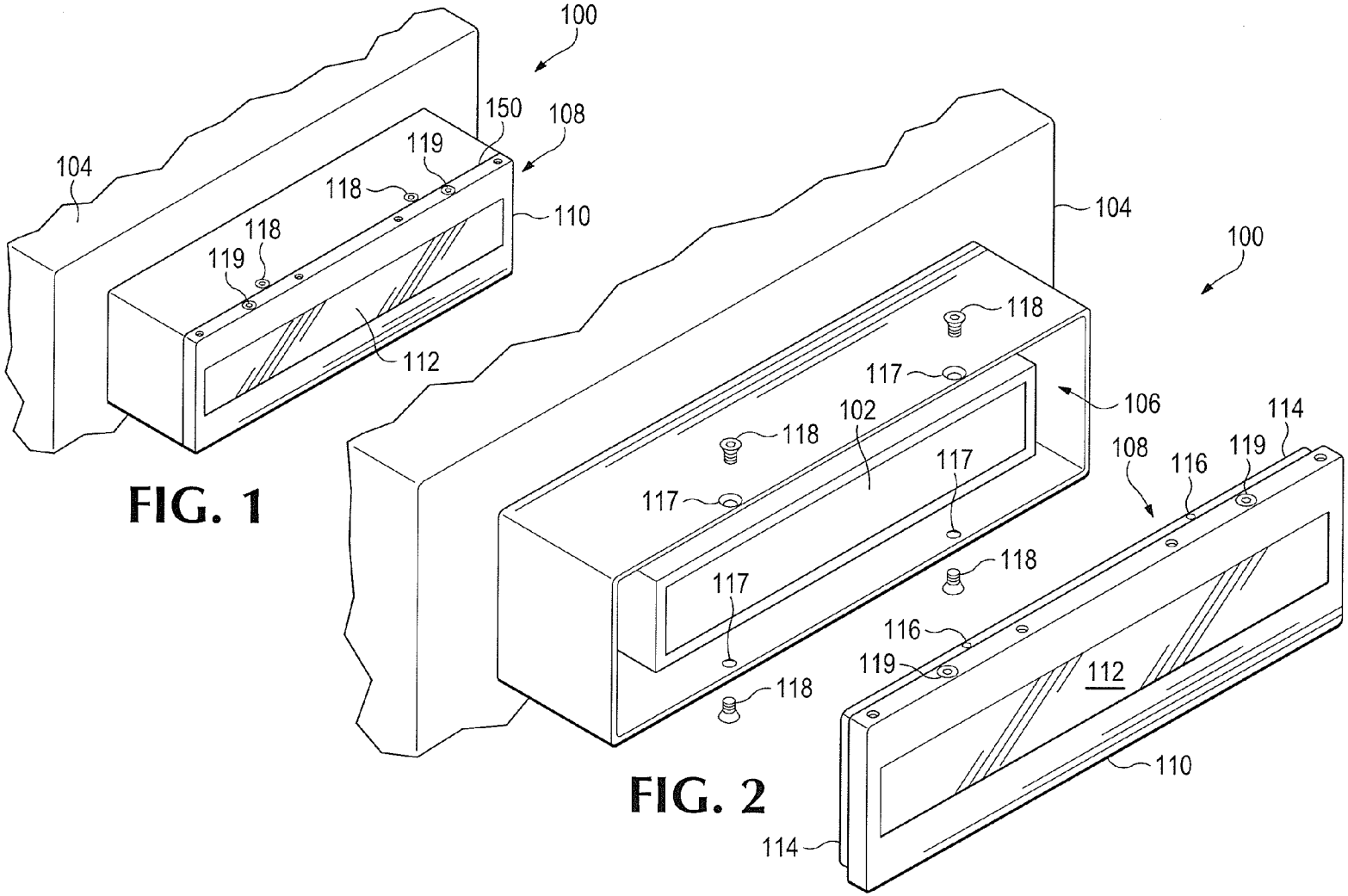
FIG. 1 shows an embodiment of a lighting module including a removable window frame.
FIG. 2 shows the lighting module illustrated in FIG. 1 with the removable window separated from the housing.

FIGS. 1 and 2 show an embodiment of a lighting module used in light curing processes. The lighting module 100 is an ultraviolet (UV) lighting module. The lighting module 100 may apply in any environment and may use any solid-state, light-emitting elements emitting light of an appropriate wavelength for curing a particular material.

In the examples illustrated in FIGS. 1 and 2, the lighting module 100 is a UV curing lighting module 100 that comprises an array of light-emitting diodes (LEDs) 102 positioned within a housing 104 that defines an opening 106. A window frame 108 is removable from the opening 106 of the housing 104 and is replaceable when any portion of the window frame 108 is damaged and needs to be replaced or is in need of repair or cleaning. The housing 104 is any suitable housing 104 and can embody any desired shape and size. The housing 104 includes any suitable materials.

Figure 3:
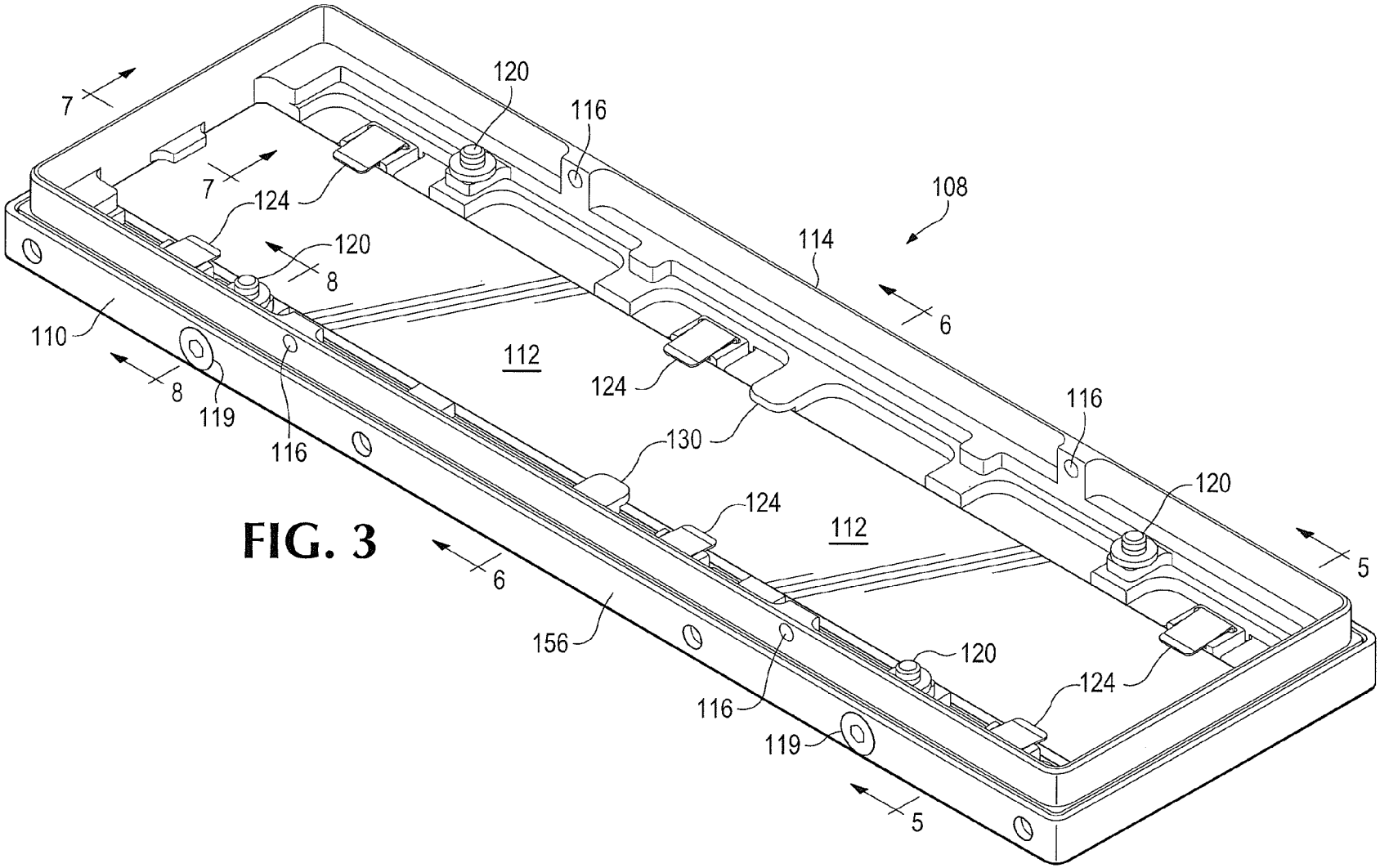
FIG. 3 illustrates a perspective view of the removable window frame illustrated in FIGS. 1 and 2.
Figure 4:
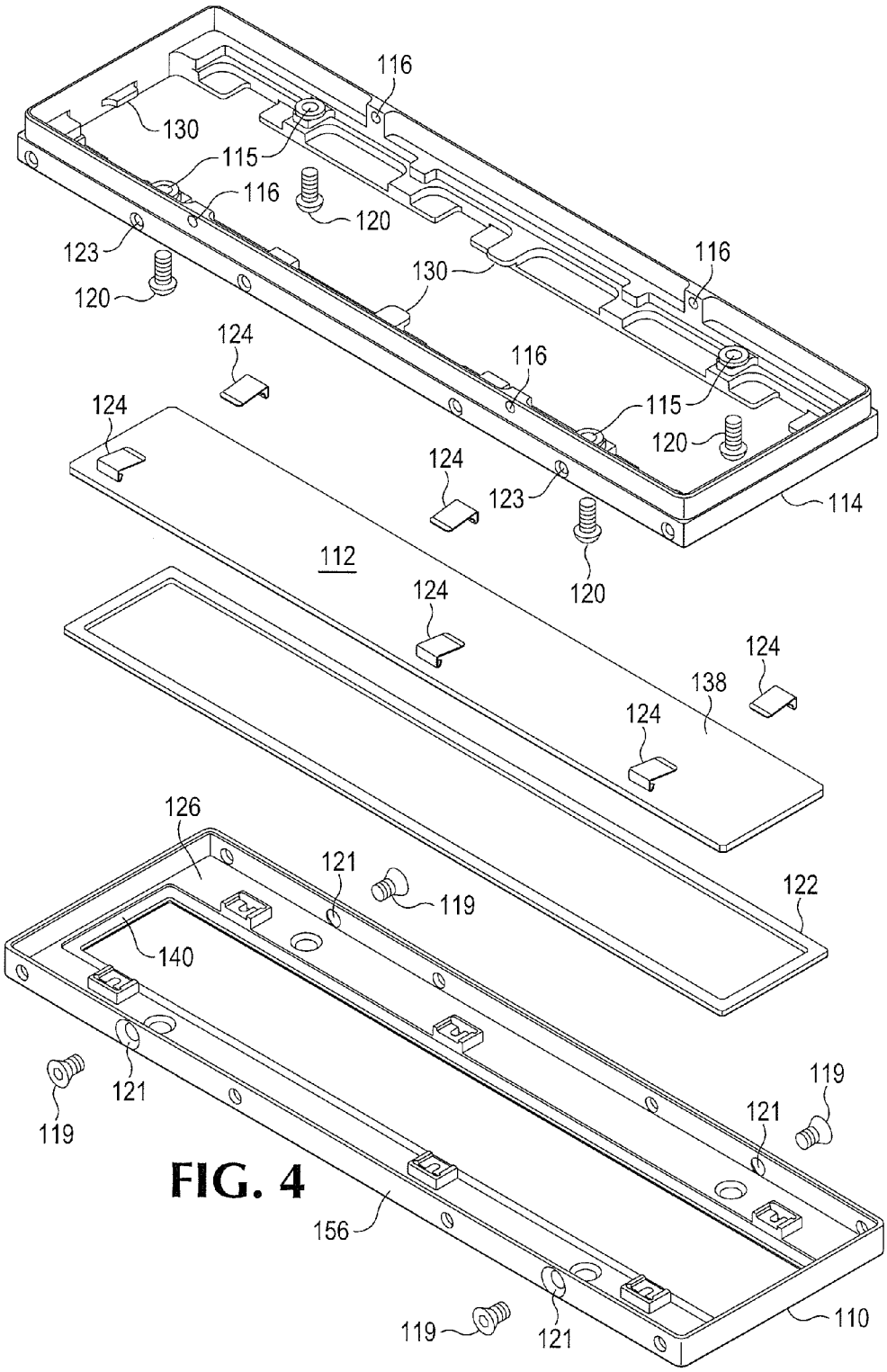
FIG. 4 illustrates an exploded view of the embodiment of the removable window frame illustrated in FIG. 3.

Further, the lighting module 100 of FIGS. 1 and 2 can reach very high temperatures as a result of the heat generated by the light-emitting elements 102. In traditional lighting modules, the window frame includes a window permanently secured to the frame via glue, cement, or another type of adhesive. FIGS. 3 and 4 illustrate an embodiment of a window frame 108 in a perspective and exploded view, respectively. The window frame 108 includes a frame 110 and a window 112 secured to and removable from the frame 110. Because the window 112 is removable from the frame 110, the window 112 is easily replaceable when it becomes worn or damaged and thus experiences less down time during repair than the windows in the traditional lighting modules.

Referring again to FIG. 1, the lighting module 100 includes the removable window frame 108 secured to the housing 104 of the lighting module 100. FIG. 2 illustrates the window frame 108 removed from the housing 104 of the lighting module 100. In this example lighting module 100, the window frame 108 is secured to the housing 104 via a connecting element 114. Screw holes 116 align with screw holes 117 in the housing 104 and screws 118 extend through aligned screw holes 116, 117 to operably secure the connecting element 114 (and the entire window frame 108 in this example) to the housing 104.

Figures 5, 6, 7, 8:
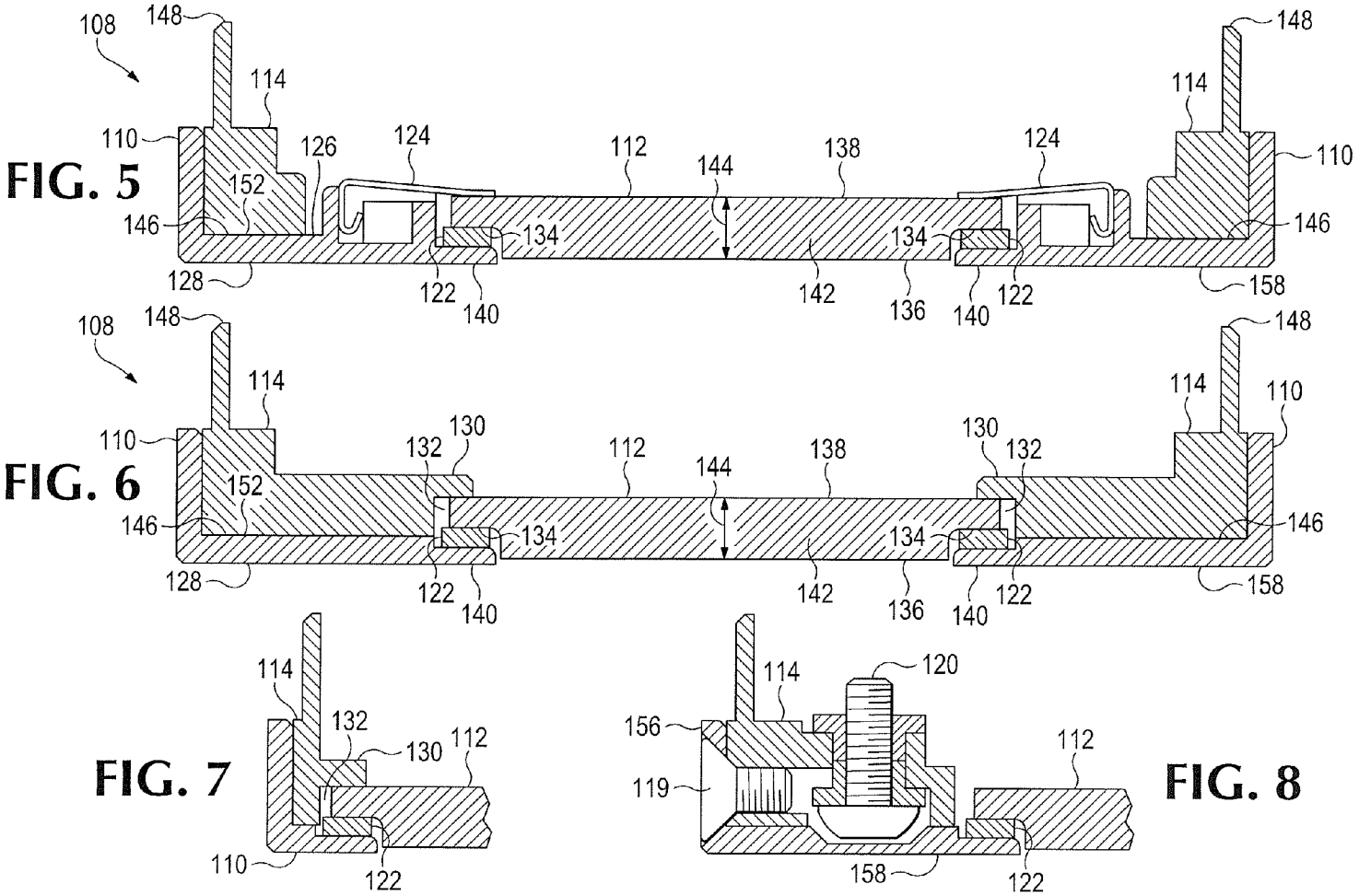
FIG. 5 illustrates a cross-sectional view of the removable window frame taken along reference line 5-5 of FIG. 3.
FIG. 6 illustrates a cross-sectional view of the removable window frame taken along reference line 6-6 of FIG. 3.
FIG. 7 illustrates a cross-sectional view of the removable window frame taken along reference line 7-7 of FIG. 3.
FIG. 8 illustrates a cross-sectional view of the removable window frame taken along reference line 8-8 of FIG. 3.

Referring now to FIGS. 3 and 4, screws 119 that extend through screw holes 121, 123 in the frame 110 and the connecting element 114, respectively to secure the frame 110 to the connecting element 114. Additionally, screws 120 extend through screw holes 115 defined in the connecting element 114. FIG. 8 best illustrates the cross-sectional view of the assembled window frame 108 in which the screw 120 extends through screw hole 115 and screw 119 extends through screw hole 121 in the frame 110 and screw hole 123 in the connecting element 114 to operably secure them together.

In some examples, the window frame 108 of lighting module 100 includes a gasket 122 positioned between the frame 110 and a portion of the window 112 that is secured to the frame 110, as illustrated in FIG. 4. In this example, the window 112 is not permanently glued or otherwise adhered to the frame 110 as is commonly found in traditional lighting modules. Rather, the window 112 and the frame 110 are secured together. The gasket 122 is positioned between the frame 110 and a portion of the window 112 that is operably secured to the frame 110 and serves as an interface between the portion of the window 112 and the portion of the frame 110 that are secured to each other, as best shown in FIGS. 5-8. The gasket 122 includes an expandable material, in some examples, which permits the frame 110 to expand and contract as the temperature of the lighting module 100 increases and decreases during use, which naturally occurs with many materials that are often used in the frame 110 (e.g., aluminum).

In traditional lighting modules, the window includes a relatively inflexible material that does not expand and contract as much as (or at all with) the frame. Since the window and the frame are permanently and directly adhered to each other in these traditional lighting modules and they have different abilities to expand and contract in response to heat, the expansion and contraction of the frame places excessive stress on the interface between the window and the frame.

Such stress placed on that interface causes the window to break away from the frame and possibly damage and/or shatter the window in the process.

FIG. 4 illustrates the expandable gasket 122 of the disclosed lighting module 100. The expandable gasket 122 provides an interface between the expandable frame 110 and the less expandable (or not expandable) window 112 to permit the frame 110 to expand without requiring the window 112 to expand and to reduce the amount of force transferred to the window 112 when the frame expands, as compared with traditional lighting module configurations. In the disclosed example lighting modules 100, the frame 110 expands as the lighting module 100 heats up during use. The expandable gasket 122 permits the window 112 and the frame 110 to move with respect to each other and "absorbs" the expansion of the frame 110 when the gasket 122 itself expands and/or stretches to accommodate the expansion of the frame 110 rather than directly transferring those forces to the window 112. Such a configuration preserves the integrity of the window 112 and prevents damage and wear to the window 112, which increases the life of the window 112 and decreases the overall cost of maintaining the lighting module 100.

In some embodiments, the frame 110 is aluminum and the window 112 is glass. As the light-emitting elements 102 emit light and generate heat, the aluminum in the frame 110 naturally expands. The glass window 112 has a much lower rate of expansion in response to heat and cannot sustain the same level of expansion as the aluminum frame 110. In essence, the gasket 122 serves as a flexible interface between the aluminum frame 110 and the glass window 112 that "absorbs" force created when the aluminum frame 110 expands and the glass window 112 does not (or expands slowly with respect to the level of expansion of the aluminum frame 110).

Further, the presence of an expandable gasket 122 helps provide a liquid-tight seal between the window 112 and the frame 110 when they are operably secured to each other. Many UV curing applications use lighting module 100, which periodically needs to be cleaned with various cleaning solutions and solvents. For example, the lighting module 100 is used during UV curing of ink. During the curing process, ink is sometimes deposited on the window 112 and needs to be cleaned off with liquid cleansers. When the cleanser is applied directly to the window or a cloth that is wiped over the window, liquid can enter the housing of the lighting module via the interface between the window and the frame in the traditional lighting module. However, in the lighting module 100 shown in FIG. 4, the gasket 122 helps provide a liquid-tight seal or interface between the window 112 and the frame 110 because it includes a liquid-phobic material and is secured to both the frame 110 and the window 112. The liquid-tight seal helps prevent liquids from entering the interior of the housing 104 and damaging the electronics positioned within.

In some examples, the expandable gasket 122 includes polytetrafluoroethylene (PTFE), which is a flexible, expandable, hydrophobic material. The expandable properties of a PTFE gasket 122 permit the frame 110 to expand while the window 112 remains stationary (or relatively stationary). The hydrophobic properties of PTFE gasket 122 help prevent liquids from entering the housing 104 at the interface between the frame 110 and the window. PTFE also is resistant to wear and damage from UV light, which makes PTFE an excellent material for the gasket 122 included in the lighting modules 100 that include light-emitting elements 102 that emit light at a wavelength (or range of wavelengths) that includes UV light.

Preventing liquids from entering the lighting module 100 preserves the integrity of the electronics positioned within the housing 104 and improves the overall reliability of the lighting module 100. As with the expandable gasket 122, all interfaces or seams between parts on the lighting module 100 expose the interior of the housing 104 to the possibility of liquids entering and causing damage to the electronics and other elements within the housing 104. To help prevent liquids from entering the housing 104 of the lighting module 100, a connecting element 114 is secured to the window frame 108 on one surface 146 and is secured to the housing 104 on an opposing surface 148, as illustrated in FIGS. 3-8. The connecting element 114 serves as an interface between the window frame 108 and the housing 104 that helps secure the housing 104 and the window frame 108 together in a manner that helps prevent liquids from entering the housing 104.

In examples that do not have a connecting element 114, the window frame 108 and the housing 104 are directly secured to each other, creating a single seam between them. In examples that include a connecting element 114, the connecting element 114 creates two seams (interfaces) 150, 152, one 150 between the connecting element 114 and the window frame 108 and a second 152 between the connecting element 114 and the housing 104, as illustrated in FIGS. 1, 5, and 6. The inclusion of additional interfaces or "seams" helps prevent liquids from entering the interior of the housing 104 and damaging or destroying the internal components by providing a more complicated pathway for liquid to enter the housing 104. Overlapping seams or interfaces provide even greater protection against liquids entering the housing 104. Oftentimes, although not always, the interfaces 150, 152 between the connecting element 114 and the housing 104 and frame 110, respectively, include overlapping corner(s) or other edges rather than a simple linear pathway that create an even more complicated pathway from the exterior to the interior of the lighting module 100. The connecting element 114 is a discrete element from both the window frame 108 and the housing 104 in these examples.

Another aspect of the disclosed lighting module 100 that helps prevent liquid from entering the interior of the housing 104 includes retaining element(s) 124 positioned on the interior surface 126 rather than the exterior surface 128 of the frame 110 that secure the window 112 and the frame 110 together. These interior retaining elements 124 also realize other benefits for the lighting module 100 in that they reduce the amount of cumbersome hardware that is located on the exterior surface 128 of the lighting module 100 and create a smooth overall appearance for the lighting module 100.

For example, the window frame 108 of the lighting module 100 illustrated in FIGS. 3-5 includes multiple retaining elements 124 that secure the window 112 and the frame 110 together. The retaining elements 124 are secured to the interior surface 126 of the frame 110 and secure the window 112 against the frame 110. In this particular example, the retaining elements 124 are stainless steel clips that are secured to the frame 110 at or near the edge of the window 112. As shown in FIG. 5, the stainless steel clips 124 extend away from the interior surface 126 of the frame 110 and over the edge of the window 112 to tightly secure the window 112 against the frame 110.

The exemplary lighting module 100 includes a related retaining element in which tabs 130 are integrally formed with the frame 110 and extend away from the frame 110 to define a space 132 into which the edge of the window 112 is positioned, as best illustrated in FIGS. 3, 4, 6, and 7. When the edge of the window 112 is positioned within this space 132, the tabs 130 help prevent the window 112 from separating from the frame 110. In the lighting module 100 shown in FIGS. 3 and 4, the frame 110 includes tabs 130 and flexible stainless clips 124 to operably secure the window 112 to the frame 110 at various locations, spaced apart from each other, around the perimeter of the window 112. FIG. 5 shows a cross-sectional view of the stainless steel clips 124 that secure or "sandwich" the window 112 and the frame 110 together (with the gasket 122 being positioned between the window 112 and frame 110).

FIG. 6 shows a cross-sectional view of the window frame 108 showing the tab 130 integrally formed with the frame 110. An edge of the window 112 is positioned within the space 132 defined between the frame 110 and the tab 130. The tab 130 may serve as a rigid retaining mechanism for operably securing the window 112 to the frame 110. The tab 130 may be secondary to the stainless steel clip 124 that may serve as the primary retaining mechanism to moderately secure the window 112 to the frame 110. This is just one example and the components may take alternative configurations. FIG. 7 shows an alternative embodiment of the tab 130. The example window frame 108 illustrated in FIG. 3 includes all three retaining mechanisms just described: multiple stainless steel clips 124 and multiple tabs 130 of both embodiments.

The strength of the materials used in the window 112 affects the reliability of the lighting module 100. As discussed above, the window 112 includes glass and the frame 110 includes aluminum in the examples shown in FIGS. 1-8. Also discussed above, the lighting module 100 generates heat during use and causes the frame 110 to expand and contract in response to the heat. The expansion and contraction process apply shear and other forces to the glass window 112. Glass is not a flexible material compared to aluminum so it does not flex during this expansion and contraction process as much as the aluminum frame 110 flexes. However, increasing the thickness of the glass increases the glass' ability to sustain greater shear forces and other stresses. In some embodiments, the glass has a thickness of at least 2.75 mm in at least some portions of the window 112. Any suitable thickness of the glass may be used.

For example, the lighting module 100 includes a glass window 112 that includes a seat 134 on a first surface 136 and a smooth surface on the opposing, second surface 138 as shown in FIGS. 5-8. The seat 134 extends around the perimeter of the first surface 136 of the glass window 112 and engages with a corresponding mating portion 140 of the frame 110. In other words, the "notched" glass window 112 includes a stair-step shape that extends around the perimeter of one surface 136 of the glass window 112, as illustrated in FIGS. 5-8. The portion of the frame 110 that is secured to the glass window 112 is shaped to include a stair-step or "notched" mating portion 140 that complements the notched portion or seat 134 of the glass window 112 when they are secured together. In such a configuration, the center portion 142 of the glass window 112 (the portion encircled by the seat 134 extending around the perimeter of the glass window 112) has a greater thickness 144 than the notched portion or seat 134 of the glass window 112, which makes the center portion 142 stronger than the seat 134. In a flat or non-notched glass window, the window 112 is a uniform thickness that overall is thinner and thus more fragile and prone to damage and wear than its "notched" counterpart. The exemplary center portion 142 of the window 112 has a thickness of at least 2.75 mm (not drawn to scale in the figures).

FIG. 8 shows a cross-sectional view of the screws 120, 154 that secure the frame 110 to the connecting element 114 and the connecting element 114 to the housing 104. The screws 120 that operably secure the connecting element 114 to the housing 104 are described above. The screws 154 secure the frame 110 to the connecting element 114 from a side surface 156 of the frame 110. This configuration permits the face surface 158 of the frame to be a solid material without screw holes (or other retaining mechanisms), which reduces the amount of liquids that are likely to enter the housing 104 when the face surface 158 of the frame 110 is cleaned after or during use or otherwise exposed to liquids.

As described above, many elements of the disclosed lighting module make replacing the window frame or portions thereof easy as compared to the more traditional lighting modules. One method of replacing a window frame in one of the disclosed lighting modules begins with manufacturing a housing defining an opening and positioning an array of light-emitting elements within the housing in any suitable manner. The housing is manufactured in any suitable manner out of any suitable material(s). A window frame, assembled in any of the manners described above, is operably secured within the opening of the housing. The window frame is removable and may be replaced when it becomes damaged or worn. For example, the lighting module illustrated in FIGS. 1 and 2 show the window frame secured to and removed from, respectively, the housing of the lighting module. Further, the window and frame are removable from each other, making the window easy to replace when it becomes worn or damaged.

Many benefits of the disclosed lighting modules have been discussed. However, additional benefits not discussed herein will become apparent to one of skill in the art upon reading this disclosure. Also, some elements of the disclosed lighting modules may be replaced with suitable substitute elements. For example, the retaining elements described above may include any suitable mechanical connectors. Although there have been described to this point particular embodiments for a method and apparatus for light curing processes, it is not intended that such specific references be considered as limitations upon the scope of this invention except in-so-far as set forth in the following claims.

What is claimed is:

1. A lighting module, comprising:

an array of light-emitting elements;

a housing defining at least one opening, wherein the array of light-emitting elements is positioned within the housing; and a window frame removable from the opening, the window frame including:

a frame;

a removable window that is secured to the frame with one or more retaining elements removable from the frame; and one or more tabs integrally formed with the frame that extend away from the frame to define a space into which the edge of the removable window is positioned, the removable window filing only a portion of the space when secured to the frame leaving an open space adjacent to the window, and wherein the tabs are positioned apart from the retaining elements and help prevent the window from separating from the frame.

2. The lighting module of claim 1, wherein the window frame further includes a gasket between the frame and a portion of the window that is operably secured to the frame.

3. The lighting module of claim 2, wherein the gasket comprises a die-cut expanded PTFE gasket.

4. The lighting module of claim 1, wherein the window includes glass that has a thickness of at least 2.75 mm.

5. The lighting module of claim 1, wherein the window frame further includes a gasket between a seat of the window and a mating portion of the frame.

6. The lighting module of claim 1, wherein each of the retaining elements includes at least one of a stainless steel clip.

7. The lighting module of claim 1, wherein the window includes a first, interior surface and an opposing, second, exterior surface, and wherein the window is secured to the frame with at least one retaining element that contacts the window on the first, interior surface to cause a seat of a window to press against a mating portion of the frame.

8. The lighting module of claim 1, wherein a connecting element is discrete from the frame.

9. The lighting module of claim 1, wherein the window includes a seat extending along a perimeter of the window such that the seat is engaged with a mating portion of the frame.

10. The lighting module of claim 1, wherein the one or more tabs from overhangs that aid in holding the removable window to the frame.

11. The lighting module of claim 1, further comprising a connecting element that includes a first surface that is secured to the frame and a second surface that is secured to the housing.

12. A lighting module, comprising:

an array of light-emitting elements;

a housing defining at least one opening, wherein the array of light-emitting elements is positioned within the housing; and a window frame removable from the opening, the window frame including:

a frame;

a removable window that is secured to the frame with one or more retaining elements removable from the frame;

a gasket positioned between a mating portion of the frame and a seat that a liquid-tight seal is formed between the window and the frame; and one or more tabs integrally formed with the frame that extend away from the frame to define a space into which the edge of the removable window is positioned, the removable window filling only a portion of the space when secured to the frame leaving an open space adjacent to the window, and wherein the tabs are positioned apart from the retaining elements and help prevent the window from separating from the frame.

13. The lighting module of claim 12, wherein the gasket comprises a die-cut expanded PTFE gasket.

14. The lighting module of claim 12, wherein the window includes a first, interior surface and an opposing, second, exterior surface, and wherein the window is secured to the frame with at least one retaining element that contacts the window on the first, interior surface to cause a seat of the window to press against a mating portion of the frame.

15. The lighting module of claim 12, wherein the window includes glass that has a thickness of at least 2.75 mm.

16. The lighting module of claim 12, wherein the window includes a seat extending along a perimeter of the window such that the sea is engaged with a mating portion of the frame and the gasket is positioned between the seat and the mating portion.

17. A method of replacing a window frame on a lighting module, comprising:

manufacturing a housing defining at least one opening;

positioning an array of light-emitting elements within the housing;

assembling a window frame that includes:

a frame selectively removable from the opening of the housing; and a window that is operably secured to the frame with one or more retaining elements removable from the frame; and one or more tabs integrally formed with the frame that extend away from the frame to define a space into which the edge of the removable window is positioned, the removable window filling only a portion of the space when secured to the frame leaving an open space adjacent to the window, and wherein the tabs are positioned apart from the retaining elements and help prevent the window from separating from the frame; and operably securing the window frame within the opening of the housing with the one or more tabs and retaining elements.

18. The method of claim 17, further comprising removing the window frame from the opening of the housing and replacing the window frame with a replacement window frame that includes:

a replacement frame removable from the opening of the housing; and a removable replacement window that is secured to the replacement frame.

19. The method of claim 17, wherein the window frame further includes a die-cut expanded PTFE gasket that is positioned between the frame and a portion of the window that is secured to the frame.

20. The method of claim 17, wherein the window includes glass that has a thickness of at least 2.75 mm.

* * * * *